US008564626B2

(12) United States Patent
Ookoba

(10) Patent No.: US 8,564,626 B2
(45) Date of Patent: Oct. 22, 2013

(54) LINE-SEQUENTIAL DRIVING DISPLAY

(75) Inventor: Minoru Ookoba, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 979 days.

(21) Appl. No.: 12/639,927

(22) Filed: Dec. 16, 2009

(65) Prior Publication Data

US 2010/0156764 A1 Jun. 24, 2010

(30) Foreign Application Priority Data

Dec. 18, 2008 (JP) ..... 2008-322682

(51) Int. Cl.
*G09G 5/10* (2006.01)

(52) U.S. Cl.
USPC ..... 345/690; 345/90; 345/89; 345/77; 345/65; 345/64; 345/63

(58) Field of Classification Search
None
See application file for complete search history.

(56) References Cited

U.S. PATENT DOCUMENTS

2007/0018552 A1* 1/2007 Cho et al. ..... 313/311
2008/0158492 A1* 7/2008 Rho et al. ..... 349/123

FOREIGN PATENT DOCUMENTS

JP 10-106450 A 4/1998
JP 2000-228151 A 8/2000

* cited by examiner

*Primary Examiner* — Joseph Haley
*Assistant Examiner* — Ifedayo Iluyomade
(74) *Attorney, Agent, or Firm* — Canon USA, Inc., IP Division

(57) ABSTRACT

A line-sequential driving display that displays an image by exciting phosphor disposed on the rear surface of a face plate, transmitting light emitted from the excited phosphor through the face plate, and emitting the light from the front surface of the face plate. The display includes a light blocking layer disposed closer to the front surface of the face plate than the phosphor, the light blocking layer being configured to control the emission and non-emission of the light from the front surface on the basis of an electrical signal. Upon driving the line-sequential driving display, an area of the light blocking layer above a line-sequential driving selected line enters a light transmitting state and at least part of an area of the light blocking layer above a line-sequential driving unselected line enters a light blocking state.

5 Claims, 4 Drawing Sheets

FIG. 6

| | | | STATE | | | | | | | RESULTANT VALUES OF PANEL | | |
|---|---|---|---|---|---|---|---|---|---|---|---|---|
| | | | LUMINANCE [cd/m²] BEFORE LIGHT BLOCKING | | DIFFUSE REFLECTIVITY [%] OF PIXEL PORTION | | TIME OCCUPANCY IN 16.6 ms | | TRANSMITTANCE OF POLARIZER +ND | | | |
| | | | MAIN LIGHT EMISSION | PERSISTENCE | UPON LIGHT TRANSMISSION OF LIGHT BLOCKING LAYER | UPON LIGHT BLOCKING OF LIGHT BLOCKING LAYER | LIGHT TRANSMISSION [ms] | OFFSET [ms] | | LUMINANCE | DIFFUSE REFLECTIVITY | CONTRAST |
| EXAMPLE 1 | WITH LIGHT BLOCKING | INITIAL STATE | 600 | 60 | 5% | 0.50% | 16.6 | 0 | 30% | 200 | 0.66% | 953:1 |
| | WITHOUT LIGHT BLOCKING | INITIAL STATE | 600 | 60 | 5% | 0.50% | 3 | 2 | 30% | 200 | 0.32% | 1960:1 |
| | TARGET VALUE | AFTER DEGRADATION OF PHOSPHOR | 400 | 40 | 5% | 0.50% | 3 | 2 | 30% | 133 | 0.32% | 1307:1 |
| EXAMPLE 2 | LIGHT BLOCKING | INITIAL STATE | 600 | 60 | 5% | 0.50% | 3 | 3 | 45% | 200 | 0.47% | 1333:1 |
| | INDEPENDENT CONTROL | AFTER DEGRADATION OF PHOSPHOR | 400 | 40 | 5% | 0.50% | 3 | 2 | 45% | 200 | 0.47% | 1333:1 |

POLARIZER AND ND FILTER WERE ARRANGED SO THAT INITIALLY REQUIRED LUMINANCE OF IMAGE DISPLAY APPARATUS WAS 200 cd/m²
CONTRASTS WERE MEASURED WITH EXERNAL ILLUMINANCE OF 100 lx

LINE-SEQUENTIAL DRIVING DISPLAY

BACKGROUND OF THE INVENTION

1. Field of the Invention

The present invention relates to a line-sequential driving display and, in particular, relates to a technique for increasing the contrast of the display.

2. Description of the Related Art

Japanese Patent Laid-Open No. 2000-228151 discloses a technique of forming a mask layer having an optical constant, varied depending on either short-wavelength light or heat caused by discharge, on a front substrate in order to prevent a reduction in contrast due to external light. Specifically, a front substrate including the mask layer has a low transmittance while a panel does not emit light. When the panel emits light, the transmittance of the front substrate including the mask layer increases. This leads to a reduced amount of reflected external light in a portion where light is not emitted, thus effectively radiating light emitted from phosphor, as disclosed in Japanese Patent Laid-Open No. 2000-228151.

Japanese Patent Laid-Open No. 10-106450 discloses a technique of partially suppressing the reflection of external light components having various wavelengths using optical filter layers and transmitting internally emitted light (internal light) through the filter layers to efficiently transmit the internal light and block the external light using the dependence of the transmittance of each filter on wavelength.

Since phosphor has long-persistence and degradation characteristics peculiar to such a material, it is necessary to perform time control of a light transmitting state and a light blocking state of a light blocking layer in accordance with a change in the characteristics. According to the technique disclosed in Japanese Patent Laid-Open No. 10-106450, although the contrast is increased, pixels reflect external light at any time during turn-off. It is therefore difficult to remarkably increase the contrast.

SUMMARY OF THE INVENTION

The present invention provides a new technique for increasing the contrast of a line-sequential driving image display apparatus.

An aspect of the present invention provides a line-sequential driving display that displays an image by exciting phosphor disposed on a first surface of a light-transmissive plate, transmitting light emitted from the excited phosphor through the light-transmissive plate, and emitting the light from a second surface of the light-transmissive plate opposite the first surface. The display includes a light blocking layer disposed closer to the second surface of the light-transmissive plate than the phosphor, the light blocking layer being configured to control the emission and non-emission of the light from the second surface on the basis of an electrical signal. Upon driving the line-sequential driving display, an area of the light blocking layer above a line-sequential driving selected line enters a light transmitting state and at least part of an area of the light blocking layer above a line-sequential driving unselected line enters a light blocking state.

In this instance, the light transmitting state means a state in which the transmittance is relatively high and the light blocking state means a state in which the transmittance is relatively low.

Light reflected due to diffuse reflection of the light blocking layer (panel) for unselected time is reduced without reducing a turn-on luminance of the display for selected time, thus increasing contrast.

Further features of the present invention will become apparent from the following description of exemplary embodiments with reference to the attached drawings.

BRIEF DESCRIPTION OF THE DRAWINGS

FIG. 6 illustrates a table showing the details of EXAMPLES 1 and 2.

DESCRIPTION OF THE EMBODIMENTS

The present invention achieves an increase in contrast of a line-sequential driving image display apparatus.

Figure 1:
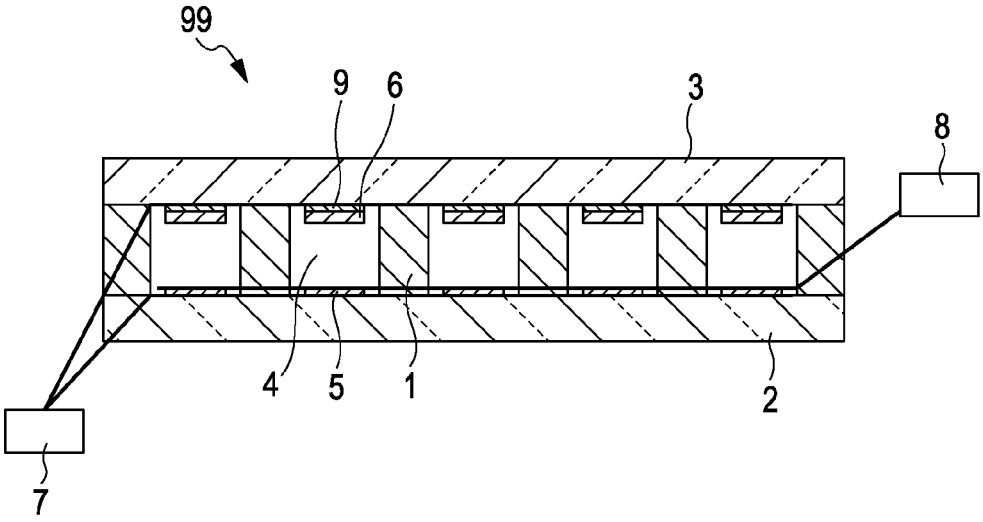
FIG. 1 is a cross sectional view of the schematic structure of an electron beam bombardment flat panel display (FPD) according to an embodiment of the present invention.

A line-sequential driving display according to an embodiment of the present invention will be described below. The line-sequential driving display according to the present embodiment is an electron beam bombardment flat panel display (FPD). The schematic structure of the electron beam bombardment FPD according to the present embodiment is illustrated in FIG. 1. FIG. 1 is a cross sectional view of the electron beam bombardment FPD, indicated at 99. The electron beam bombardment FPD 99 includes a rear plate 2 that is light-transmissive, a face plate 3 that is also light-transmissive, and a partition member 1 as a vacuum holding member. The partition member 1 is disposed between the rear plate 2 and the face plate 3. A space 4 between the rear plate 2 and the face plate 3 is vacuum-sealed.

A first surface (rear surface) of the face plate 3 facing the space 4 is provided with phosphor 6 formed in a matrix pattern. On one surface of the rear plate 2 facing the space 4, electron emitters 5 which emit electrons are arranged. A power source 7 applies a voltage between the rear plate 2 and the face plate 3, thus forming an electric field which accelerates the electrons.

On the rear plate 2, driving lines including scanning lines and signal lines are arranged in a matrix such that the driving lines are connected to the electron emitters 5 and a signal source 8. Electron emission/non-emission is controlled in accordance with a signal output from the signal source 8. The intersections of the scanning lines and the signal lines in the matrix correspond to pixels arranged on the face plate 3, respectively. Upon driving, electrons are emitted from the electron emitters 5 of a selected line. The emitted electrons are accelerated and then collide with the face plate 3 and the phosphor 6, thereby exciting the phosphor 6 disposed in the pixels. Light emitted from the excited phosphor 6 is transmitted through the face plate 3 so as to be emitted from a second surface (front surface) of the face plate 3 opposite the first surface, thus displaying an image. In addition, color filters 9 are arranged between the phosphor 6 and the face plate 3. The color filters 9 have both of an effect of blocking incoming external light to reduce diffuse reflection and an effect of adjusting the color of luminescence.

In the electron beam bombardment FPD 99 according to the present embodiment, a light blocking layer capable of controlling the emission and non-emission of light from the second surface of the face plate 3 on the basis of an electrical signal is disposed closer to the second surface of the face plate 3 than the phosphor 6 disposed on the first surface of the face plate 3. Upon driving, an area of the light blocking layer above a selected line enters a light transmitting state and at least part of an area thereof above an unselected line enters a light blocking state, thus controlling the emission and non-emission of light in the electron beam bombardment FPD 99. In this instance, "above a line" means "above a line in the direction in which light is emitted from the second surface".

Figure 2:
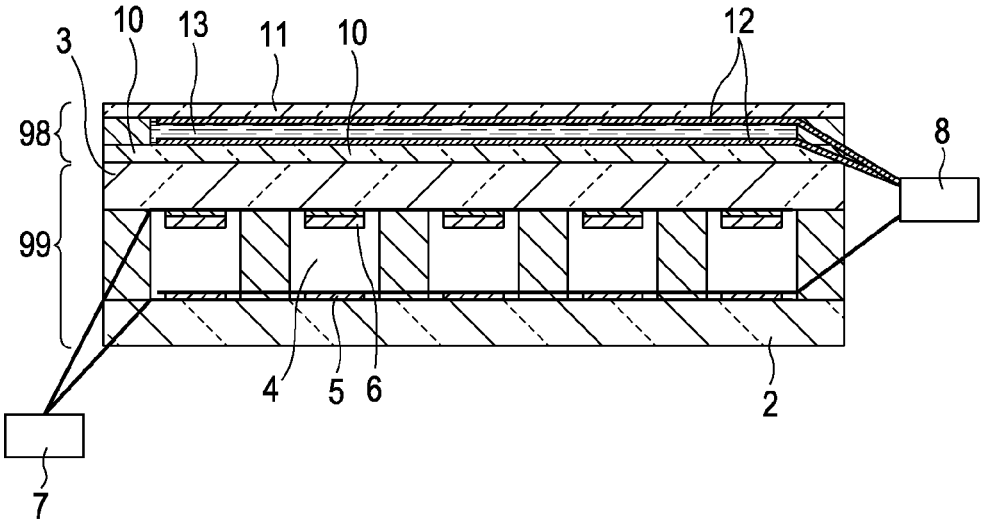
FIG. 2 is a cross sectional view of a display including a liquid crystal layer (liquid crystal panel) as a light blocking layer.

The above-described light blocking layer includes a liquid crystal layer or a layer in which blocking plates are opened and closed. FIG. 2 illustrates a case where a liquid crystal layer (liquid crystal panel) is used as the light blocking layer. The liquid crystal panel, indicated at 98, includes a liquid-crystal rear plate 10 and a liquid-crystal face plate 11 which face each other to hold liquid crystal therebetween. A pair of transparent electrodes 12 for controlling the light transmitting state and the light blocking state of the liquid crystal layer are arranged between the plates. In addition, transmissive liquid crystal 13 is sealed between the pair of transparent electrodes 12. The transparent electrodes 12 are connected to the signal source 8. The liquid crystal panel 98 and the electron beam bombardment FPD 99 are laminated such that the liquid-crystal rear plate 10 faces the face plate 3. Particularly, in order to optically reduce the transmittance of the interface, it is preferred that the liquid-crystal rear plate 10 be joined to the face plate 3 with an adhesive.

Figure 3:
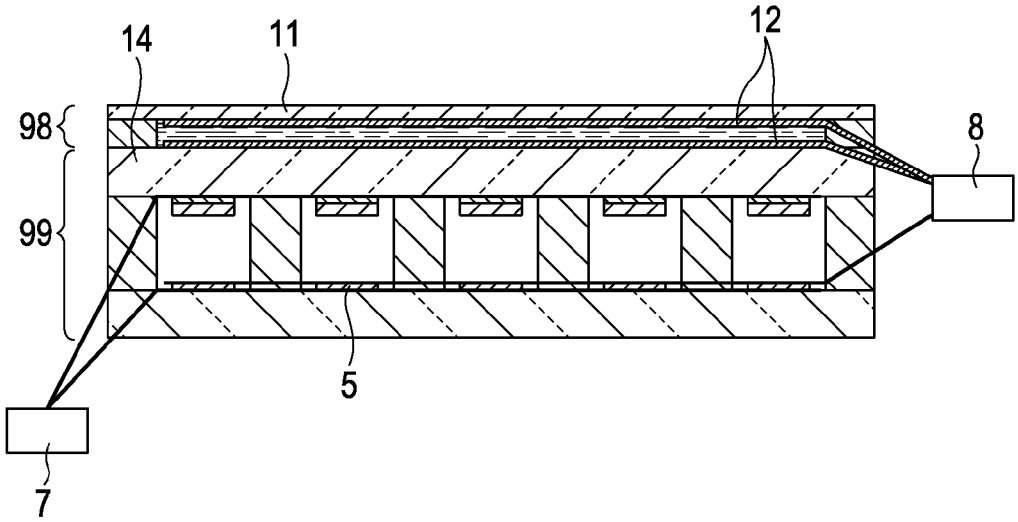
FIG. 3 is a cross sectional view of a display including a plate that serves as both of a face plate and a liquid-crystal rear plate shown in FIG. 2.

The face plate 3 and the liquid-crystal rear plate 10 may be combined into a common plate 14. In this case, it is unnecessary to join the plates using an adhesive. This prevents a reduction in intensity of transmitting light. FIG. 3 illustrates the use of the common plate 14, serving as both of the face plate 3 and the liquid-crystal rear plate 10 shown in FIG. 2.

Placing the liquid crystal between the face plate 3 and the phosphor 6 minimizes a light blocking range as much as possible, thus achieving both of an increase in contrast and an increase in angle of view.

Figure 4:
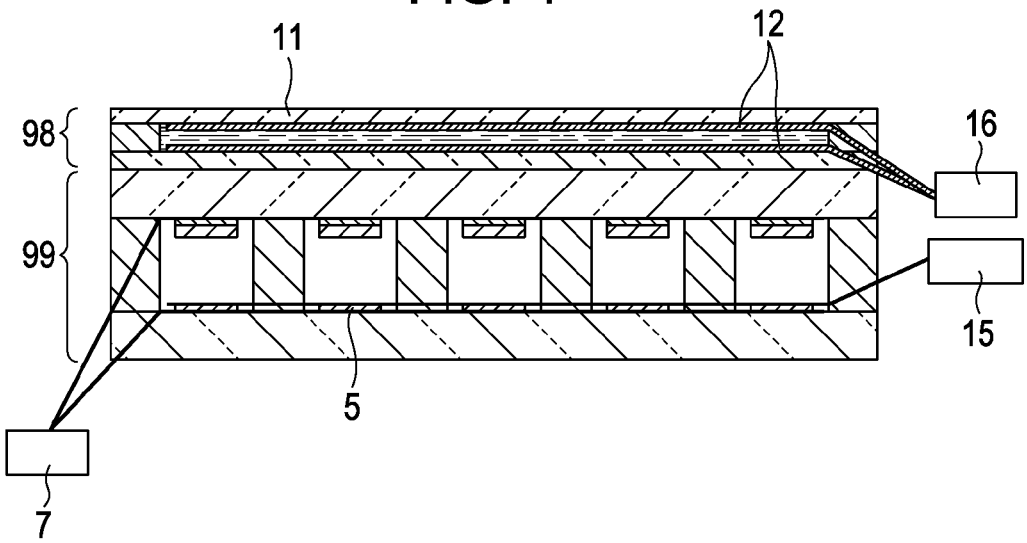
FIG. 4 is a cross sectional view of a display having a signal source for light blocking and a signal source for display such that the signal sources are separated from each other.

Referring to FIG. 4, a display signal source 15 and a light-blocking signal source 16 may be separated from each other so that scan signals for line-sequential driving display are controlled independently of scan signals for light transmission and light blocking of the light blocking layer, thus optimizing the contrast and the luminance of the display. In addition, the color filters can be omitted by adjustment.

Concrete examples of the present invention will be described in more detail below.

EXAMPLE 1

EXAMPLE 1 relates to an increase in contrast of a line-sequential driving image display apparatus including a light blocking layer capable of controlling light transmission and light blocking. Such a line-sequential driving FPD will now be described.

In this example, PD200 manufactured by Asahi Glass Co., Ltd. was used as the rear plate 2. Copper was deposited on the rear plate 2 by sputtering, thus forming a copper layer. The copper layer was patterned to form scanning lines. The number of scanning lines was 1080. In addition, surface-conduction electron emitters were arranged. Signal lines were disposed on the emitters. On the other hand, PD200 manufactured by Asahi Glass Co., Ltd. was used as the face plate 3. A film of ITO was formed as an electrode for high field application on the face plate 3. The film was patterned. Phosphor P22 manufactured by Kasei Optonix, Ltd., which has been merged into Mitsubishi Chemical Corporation, was disposed on the patterned film. The face plate and rear plate formed as described above were joined in a chamber vacuumed to $10^{-5}$ Pa, thus forming the line-sequential driving FPD. The formed line-sequential driving FPD had a luminance of 660 cd/m$^2$ before the light blocking layer was provided for the FPD.

The light blocking layer will now be described. In this example, liquid crystal was used as the light blocking layer. Blue sheet glass was used for the liquid-crystal rear plate 10 and the liquid-crystal face plate 11. A film of ITO was formed on each plate and the film was patterned, thus forming scanning lines whose number was 1080. Beads for spacing were arranged between the liquid-crystal rear plate 10 and the liquid-crystal face plate 11 formed as described above. The edges of the plates were sealed and liquid crystal was injected into the space between the plates.

The liquid crystal layer formed as described above was joined to the line-sequential driving FPD with an adhesive. In addition, a polarizer and a neutral density (ND) filter were used to suppress specular reflection and adjust the final luminance. The transmittance of the polarizer was set to 50% and that of the combination of the polarizer and the ND filter was set to 30%. The diffuse reflectivity of each of the polarizer and the ND filter was 0.2%. The polarizer and the ND filter were set so that the luminance was 200 cd/m$^2$. The line-sequential driving FPD including the light blocking layer capable of controlling light transmission and light blocking was formed in the above-described manner. In this line-sequential driving FPD, the diffuse reflectivity upon light blocking was 0.25% and that upon light transmission was 0.66%.

Figure 5:
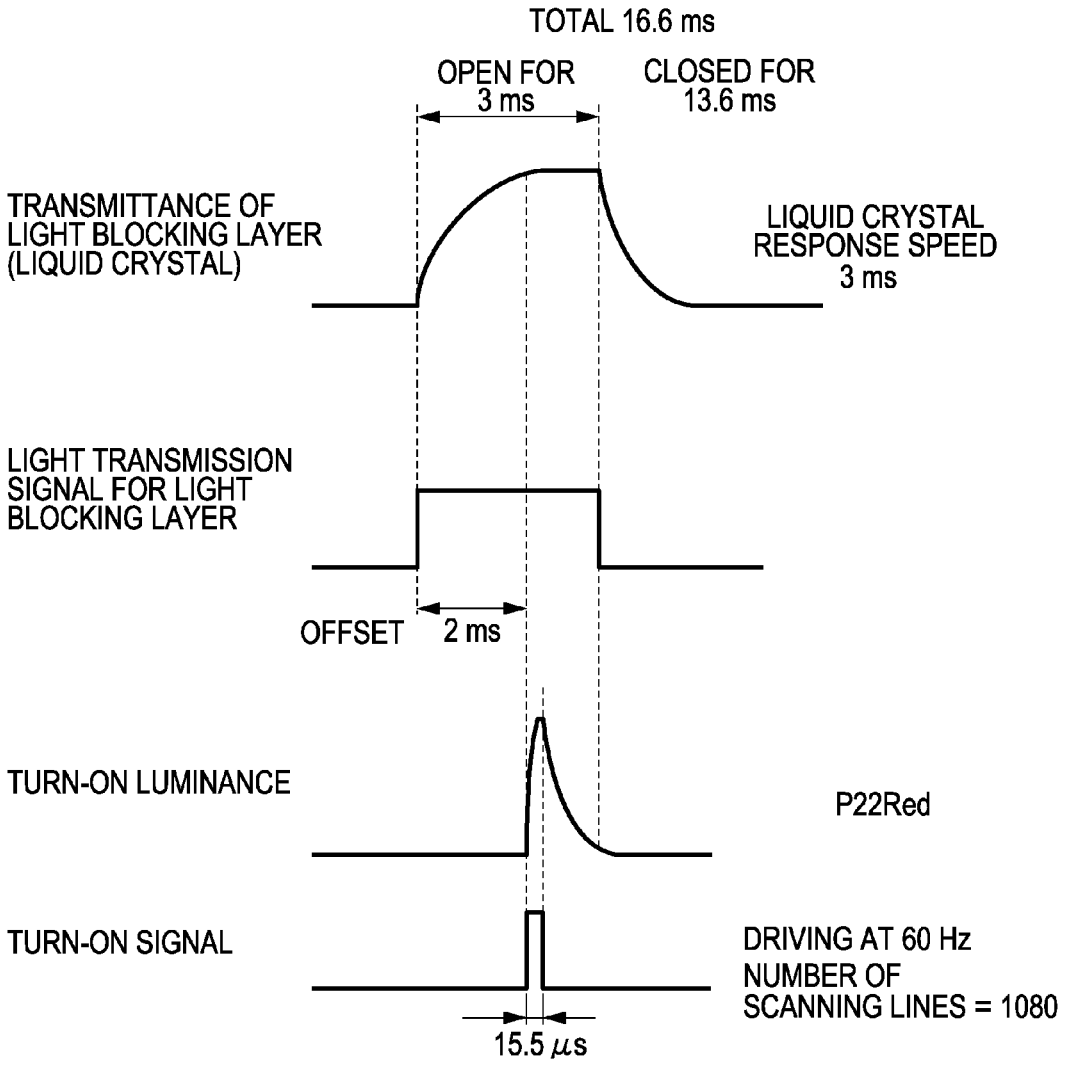
FIG. 5 is a diagram illustrating driving conditions in EXAMPLE 1.

A driving method will now be described. A driving frequency for the line-sequential driving FPD was 60 Hz. The light blocking layer for light transmission and light blocking was driven at the same driving frequency. A light transmission signal was allowed to have an offset of 2 ms from a turn-on signal and was set to be a transmission ON signal for light transmission of 3 ms in total. This driving resulted in doubling the contrast at an illuminance of 100 lx. FIG. 5 illustrates the above-described driving conditions.

EXAMPLE 2

In EXAMPLE 2, light transmission and light blocking of the light blocking layer can be driven independently of light emission driving. The structure of a line-sequential driving FPD and that of a light blocking layer are fundamentally the same as those in the above-described EXAMPLE 1. In EXAMPLE 2, the transmission of the combination of a polarizer and an ND filter was set to 45%. Furthermore, in order to independently drive the light blocking layer, a signal source was separated into a light-blocking signal source and a display signal source. In addition, a timing signal for starting light emission for the display signal source could be transmitted. Specifically, the light-blocking signal source controlled light emission timing independently of an offset time of a light transmission signal for the light blocking layer.

In an initial driving state, the offset time was set to 3 ms. After driving for 500 h, the offset time was set to 2 ms in consideration of degradation.

An initial luminance obtained before light passed through the polarizer and the ND filter was 660 cd/m$^2$. After degradation, the luminance was 440 cd/m$^2$.

Since the transmittance of the combination of the polarizer and the ND filter was set to 45%, the luminance of the line-sequential driving FPD was 200 cd/m$^2$. The luminance and contrast after degradation could be the same as those in the initial state. In the line-sequential driving FPD according to the present example, the diffuse reflectivity upon light blocking was 0.30% and that upon light transmission was 1.23%.

As compared to the case without controlling light transmission and light blocking, an increase in contrast by 1.5 times or more could be achieved at an illuminance of 100 lx.

When light transmission and light blocking of the light blocking layer are controlled independently of light emission driving as in the present example, light transmission timing and light blocking timing can be changed relative to a turn-on signal. Thus, a reduction in luminance and that in contrast due to degradation of phosphor can be suppressed. Furthermore, even when these advantages are realized, the power consumption is not changed before and after degradation of phosphor.

FIG. 6 illustrates a table showing the details of the above-described EXAMPLES 1 and 2.

The electron beam bombardment FPDs, serving as line-sequential driving image display apparatuses, according to the embodiment and examples of the present invention have been described. The line-sequential driving image display apparatuses according to the present invention include a liquid crystal display, an organic electroluminescent (EL) display, an inorganic EL display, and a plasma bombardment display. In particular, the plasma bombardment display and the electron beam bombardment display each utilize excitation light emission of phosphor in a light emitting mechanism for image display. Since these displays use phosphor particles in the order of submicrons to several microns, scattered light is large when external light enters pixels. Accordingly, the above-described advantages are distinguished. Furthermore, the plasma bombardment display and the electron beam bombardment display have characteristics in which relatively long light blocking time can be provided relative to light transmitting time. Accordingly, the effect of increasing the contrast and the effect of suppressing the reduction in luminance according to the present invention are further enhanced.

The light blocking layers in accordance with the present invention include a light blocking layer using liquid crystal and a light blocking layer in which blocking plates are opened and closed. In particular, the light blocking layer using liquid crystal has advantages in that a reduction in thickness can be easily achieved and a material having an electrical response suitable for intended purpose can be easily selected.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-322682 filed Dec. 18, 2008, which is hereby incorporated by reference herein in its entirety.

What is claimed is:

1. A line-sequential driving display that displays an image by exciting phosphor disposed on a first surface of a light-transmissive plate, transmitting light emitted from the excited phosphor through the light-transmissive plate, and emitting the light from a second surface of the light-transmissive plate opposite the first surface, comprising:

a light blocking layer disposed closer to the second surface of the light-transmissive plate than the phosphor, the light blocking layer being configured to control the emission and non-emission of the light from the second surface on the basis of an electrical signal, wherein upon driving the line-sequential driving display, an area of the light blocking layer above a line-sequential driving selected line enters a light transmitting state and at least part of an area of the light blocking layer above a line-sequential driving unselected line enters a light blocking state, and wherein control of the light transmitting state and the light blocking state of the light blocking layer is independent of control of line-sequential driving.

2. The line-sequential driving display according to claim 1, wherein the light blocking layer is a liquid crystal layer disposed on the second surface of the light-transmissive plate.

3. The line-sequential driving display according to claim 2, wherein the liquid crystal layer comprises a liquid-crystal rear plate laid on the light-transmissive plate, a liquid-crystal face plate facing the liquid-crystal rear plate, and liquid crystal held between the liquid-crystal rear plate and the liquid-crystal face plate.

4. The line-sequential driving display according to claim 2, wherein the liquid crystal layer comprises a liquid-crystal face plate facing the light-transmissive plate and liquid crystal held between the light-transmissive plate and the liquid-crystal face plate.

5. The line-sequential driving display according to claim 1, wherein a signal source that outputs a signal for the line sequential driving is disposed separately from a signal source that outputs a signal for controlling the light transmitting state and the light blocking state of the light blocking layer.

* * * * *